US009214275B2

(12) United States Patent
Omura et al.

(10) Patent No.: US 9,214,275 B2
(45) Date of Patent: Dec. 15, 2015

(54) METHOD FOR MANUFACTURING GRAIN ORIENTED ELECTRICAL STEEL SHEET

(75) Inventors: Takeshi Omura, Chiyoda-ku (JP); Gou Kijima, Chiyoda-ku (JP); Makoto Watanabe, Chiyoda-ku (JP)

(73) Assignee: JFE STEEL CORPORATION, Tokyo (JP)

( * ) Notice: Subject to any disclaimer, the term of this patent is extended or adjusted under 35 U.S.C. 154(b) by 298 days.

(21) Appl. No.: 13/988,730

(22) PCT Filed: Nov. 25, 2011

(86) PCT No.: PCT/JP2011/006576

§ 371 (c)(1),
(2), (4) Date: Jun. 14, 2013

(87) PCT Pub. No.: WO2012/070249

PCT Pub. Date: May 31, 2012

(65) Prior Publication Data

US 2013/0263976 A1 Oct. 10, 2013

(30) Foreign Application Priority Data

Nov. 26, 2010 (JP) ..... 2010-264091
Sep. 5, 2011 (JP) ..... 2011-193236

(51) Int. Cl.
*C21D 8/02* (2006.01)
*H01F 1/16* (2006.01)
(Continued)

(52) U.S. Cl.
CPC *H01F 41/00* (2013.01); *C21D 1/76* (2013.01); *C21D 8/0263* (2013.01);
(Continued)

(58) Field of Classification Search
None
See application file for complete search history.

(56) References Cited

U.S. PATENT DOCUMENTS 4,576,658 A 3/1986 Inokuti et al.
2002/0007870 A1 1/2002 Ohata et al.
(Continued)

FOREIGN PATENT DOCUMENTS

CN 1236824 A 12/1999
CN 1329176 A 1/2002
(Continued)

OTHER PUBLICATIONS

Machine-English translation of JP 2005-240147A , Hayakawa Yasuyuki et al.,Sep. 8, 2005.*
(Continued)

*Primary Examiner* — Deborah Yee
(74) *Attorney, Agent, or Firm* — Oliff PLC

(57) ABSTRACT

According to the present invention, a grain oriented electrical steel sheet in which iron loss has been further reduced can be obtained by carrying out decarburization annealing as continuous annealing including: (1) heating the steel sheet to a temperature in the range of 700° C. to 750° C. at heating rate of 50° C./second or higher at least in a temperature range of 500° C. to 700° C. in an atmosphere having oxidation potential $P(H_2O)/P(H_2)$ equal to or lower than 0.05; (2) then cooling the steel sheet to a temperature range below 700° C. in an atmosphere having oxidation potential $P(H_2O)/P(H_2)$ equal to or lower than 0.05; and (3) reheating the steel sheet to a temperature in the range of 800° C. to 900° C. and retaining the steel sheet at the temperature for soaking in an atmosphere having oxidation potential $P(H_2O)/P(H_2)$ equal to or higher than 0.3.

8 Claims, 3 Drawing Sheets

(51) Int. Cl.

| | |
|---|---|
| ***H01F 41/00*** | (2006.01) |
| ***C21D 1/76*** | (2006.01) |
| ***C21D 8/12*** | (2006.01) |
| ***C22C 38/00*** | (2006.01) |
| ***C22C 38/04*** | (2006.01) |
| ***C22C 38/60*** | (2006.01) |

(52) U.S. Cl.
CPC ..... *C21D 8/1222* (2013.01); *C21D 8/1233* (2013.01); *C21D 8/1255* (2013.01); *C22C 38/001* (2013.01); *C22C 38/04* (2013.01); *C22C 38/60* (2013.01); *H01F 1/16* (2013.01)

(56) References Cited

U.S. PATENT DOCUMENTS

| | | | |
|---|---|---|---|
| 2002/0011278 | A1 | 1/2002 | Komatsubara et al. |
| 2006/0076086 | A1 | 4/2006 | Terashima et al. |
| 2009/0032142 | A1 | 2/2009 | Kumano et al. |

FOREIGN PATENT DOCUMENTS

| | | | |
|---|---|---|---|
| CN | 101311287 | A | 11/2008 |
| CN | 101395284 | A | 3/2009 |
| EP | 0 334 223 | A2 | 9/1989 |
| EP | 0 926 250 | A1 | 6/1999 |
| EP | 0 987 343 | A1 | 3/2000 |
| EP | 2 025 766 | A1 | 2/2009 |
| EP | 2 644 716 | A1 | 10/2013 |
| JP | A-1-290716 | | 11/1989 |
| JP | A-6-212262 | | 8/1994 |
| JP | A-7-62436 | | 3/1995 |
| JP | A-7-316656 | | 12/1995 |
| JP | A-8-143973 | | 6/1996 |
| JP | A-10-46251 | | 2/1998 |
| JP | A-10-287926 | | 10/1998 |
| JP | A-10-298653 | | 11/1998 |
| JP | A-2000-129356 | | 5/2000 |
| JP | A-2000-204450 | | 7/2000 |
| JP | A-2002-60842 | | 2/2002 |
| JP | A-2003-27194 | | 1/2003 |
| JP | A-2004-315915 | | 11/2004 |
| JP | A-2010-236013 | | 10/2010 |
| JP | A-2011-174138 | | 9/2011 |

OTHER PUBLICATIONS

Extended European Search Report issued in European Patent Application No. 11842997.6 on Sep. 3, 2014.
Chinese Office Action issued in Chinese Patent Application No. 201180057035.3 on Jul. 24, 2014 (with translation).
Sep. 11, 2013 Office Action issued in Taiwanese Patent Application No. 100143328 (with translation).
Feb. 11, 2015 Office Action issued in Canadian Patent Application No. 2,818,926.
Jan. 10, 2014 Office Action issued in Chinese Patent Application No. 201180057035.03 (with translation).
Feb. 21, 2012 International Search Report issued in International Application No. PCT/JP2012/006576.

* cited by examiner

METHOD FOR MANUFACTURING GRAIN ORIENTED ELECTRICAL STEEL SHEET

TECHNICAL FIELD

The present invention relates to a method for manufacturing a grain oriented electrical steel sheet having very low iron loss and suitable for use in an iron core material of a transformer and the like.

PRIOR ART

An electrical steel sheet is widely used for a material of an iron core of a transformer, a generator and the like. A grain oriented electrical steel sheet having crystal orientations highly concentrated in {110}<001> Goss orientation, in particular, exhibits good iron loss properties which directly contribute to decreasing energy loss in a transformer, a generator and the like. Regarding further improving the iron loss properties of a grain oriented electrical steel sheet, such improvement can be made by decreasing sheet thickness of the steel sheet, increasing Si content of the steel sheet, improving crystal orientation, imparting tension to the steel sheet, smoothing surfaces of the steel sheet, carrying out grain-size refinement of secondary recrystallized grains, and the like.

Each of Patent Literatures 1 to 4, for example, discloses as technique for grain-size refinement of secondary recrystallized grains a method for rapidly heating a steel sheet during decarburization annealing, a method for rapidly heating a steel sheet immediately before decarburization annealing to improve texture of primary recrystallization, and the like.

CITATION LIST

Patent Literature

PTL 1: JP-A H10-298653
PTL 2: JP-A H07-062436
PTL 3: JP-A 2003-027194
PTL 4: JP-A 2000-204450

SUMMARY OF THE INVENTION

Technical Problems

However, the aforementioned conventional techniques, although they bring in some effects of improving iron loss properties, cannot attain sufficiently satisfactory results in terms of further improvement in iron loss properties required for the higher level of energy conservation in recent trends.

The present invention aims at advantageously addressing such prior art problems as described above and an object thereof is to provide a method for manufacturing a grain oriented electrical steel sheet having even better iron loss properties than the conventional grain oriented electrical steel sheets.

Solution to the Problems

The inventors of the present invention, as a result of a dedicated study to achieve the aforementioned object, discovered that improvement of texture by optimizing heating rate in decarburization annealing and improvement of subscale morphology by controlling the annealing atmosphere in decarburization annealing of a grain oriented electrical steel sheet, being realized in combination, results in both successful grain-size refinement of secondary recrystallized grains (secondary grains) and higher tension imparted by forsterite film which are effective in terms of reducing iron loss, so that the grain oriented electrical steel sheet can exhibit much better iron loss properties due to a synergetic effect of the two abovementioned effects. Specifically, the important aspects regarding decarburization annealing in terms of successfully refining grain size of secondary grains and enhancing tension imparted by forsterite film are as follows.

(a) Grain-Size Refinement of Secondary Grain

A steel sheet is to be heated at heating rate of 50° C./second or higher at least in a temperature range of 500° C. to 700° C. in decarburization annealing so that presence density of Goss-oriented grains in primary recrystallization texture increases.

(b) Enhancement of Tension Imparted by Forsterite Film

Allowing subscales to be formed in a state where a steel sheet is free of strains is important in order to enhance tension imparted by forsterite film. That is, subscale morphology advantageous for enhancing forsterite film tension, which was not attained by the prior art, can be obtained by heating a steel sheet in a non-oxidizing atmosphere to a temperature range of 700° C. to 750° C. to release strains introduced to the steel sheet and then allowing subscales to be formed on the steel sheet in an oxidizing atmosphere in decarburization annealing process.

In addition, it is also important to allow subscales to be formed at temperatures below 700° C. That is, the steel sheet must be cooled to below 700° C. after the release of strains in order to have satisfactory subscales formed thereon in continuous annealing.

Details of the tests from which the aforementioned discoveries were derived will be described hereinafter.

Experiment 1

A steel slab having a chemical composition including by mass %, C: 0.05%, Si: 3.2%, Mn: 0.05%, Al: 0.025% and N: 0.006%, and the balance as Fe and incidental impurities was prepared by continuous casting and the slab was subjected to heating at 1400° C. and hot rolling to be finished to a hot rolled steel sheet having sheet thickness: 2.3 min. The hot rolled steel sheet thus obtained was subjected to hot band annealing at 1100° C. for 80 seconds. The steel sheet was then subjected to cold rolling so as to have sheet thickness: 0.50 mm. A cold rolled steel sheet thus obtained was subjected to: intermediate annealing in an atmosphere having oxidation potential ($P(H_2O)/P(H_2)$) of 0.30 at 850° C. for 300 seconds; pickling by hydrochloric acid to remove subscales from a surface thereof; another cold rolling so as to have sheet thickness: 0.23 mm; and decarburization annealing in an atmosphere having oxidation potential $P(H_2O)/P(H_2)$ of 0.50 at 830° C. for 200 seconds. Heating rate was changed for respective steel sheets in the range of 500° C. to 700° C. during the decarburization annealing. The resulting steel sheets were then each subjected to coating with annealing separator mainly composed of MgO and final annealing, whereby steel sheet samples of Experiment 1 were obtained.

FIG. 1 as a graph shows relationship between grain size of secondary recrystallized grains (i.e. secondary grain size) vs. heating rate, observed in the steel sheet samples. Here the secondary grain size was determined as the equivalent circle diameter, which was deduced through counting the number of secondary grains present in the steel sheet sample of 1 m length and 1 m width and calculating area per one secondary grain to determine diameter of the circle having equivalent area of each grain. It is known from FIG. 1 that refinement of secondary grain size can be achieved by setting the heating rate to be 50° C./second or higher and preferably 100° C./second or higher.

Experiment 2

Cold rolled steel sheets, prepared according to the same protocol as Experiment 1, were subjected to decarburization annealing. In this occasion, a group of the cold rolled steel sheets were subjected to: heating from the room temperature to 730° C. at heating rate of 300° C./second in an atmosphere having oxidation potential $P(H_2O)/P(H_2)$ in the range of 0.001 to 0.3 changed for each steel sheet; cooling to 680° C. (the cooling stop temperature); reheating to 830° C.; and soaking at 830° C. for 200 seconds. Another group of the cold rolled steel sheets were subjected to: heating from the room temperature to 730° C. at heating rate of 300° C./second in an atmosphere having a certain oxidation potential $P(H_2O)/P(H_2)$ value in the range of 0.001 to 0.3; cooling to the cooling stop temperature changed for each steel sheet; reheating to 830° C.; and soaking at 830° C. for 200 seconds. Oxidation potential $P(H_2O)/P(H_2)$ of the atmosphere during the reheating and the soaking was 0.5 in both groups. The resulting steel sheets were then each subjected to coating with MgO and then final annealing, whereby steel sheet samples of Experiment 2 were obtained.

FIG. 2 shows the investigation results of relationship between oxidation potential of atmosphere during heating in decarburization annealing vs. magnitude of warpage of a steel sheet (i.e. tension imparted by forsterite film), observed in the steel sheet samples. FIG. 3 shows the investigation results of relationship between cooling stop temperature (i.e. reheating start temperature) vs. magnitude of warpage of a steel sheet (i.e. tension imparted by forsterite film), observed in the steel sheet samples. Tension imparted by forsterite film was evaluated by collecting a test specimen (length in the rolling direction: 300 mm, length in the transverse direction orthogonal to the rolling direction: 100 mm) from each steel sheet sample, removing forsterite film from one surface of the test specimen, and measuring magnitude of warpage generated in the test specimen. The larger magnitude of warpage represents the larger tension imparted by forsterite film. Forsterite film tension of a steel sheet is evaluated according to such magnitude of warpage of the steel sheet as described above in the present invention.

It is understood from the results shown in FIG. 2 and FIG. 3 that tension imparted by forsterite film is enhanced when oxidation potential $P(H_2O)/P(H_2)$ of atmosphere is $\leq 0.05$ and the cooling stop temperature is <700° C. (preferably oxidation potential of atmosphere is $\leq 0.01$ and the cooling stop temperature is $\leq 650°$ C.) in decarburization annealing.

Tension imparted by forsterite film changes according to the conditions described above presumably because morphology of subscales formed on a steel sheet changes depending on magnitude of strain remained in the steel sheet at the temperature where formation of subscale starts. Specifically, subscale having the optimum morphology to enhance tension imparted by forsterite film is formed, by removing strain from the steel sheet in a non-oxidizing atmosphere and then allowing subscale to be formed thereon again from the lower temperature.

Experiment 3

Cold rolled steel sheets, prepared according to the same protocol as Experiment 1, were subjected to decarburization annealing. On this occasion, the cold rolled steel sheets were subjected to: heating from the room temperature to temperatures in the range of 700° C. to 820° C. changed for each steel sheet at heating rate of 300° C./second in an atmosphere having oxidation potential $P(H_2O)/P(H_2)$ of 0.01; cooling to 650° C.; reheating to 830° C.; and soaking at 830° C. for 200 seconds. Oxidation potential $P(H_2O)/P(H_2)$ of the atmosphere during the reheating and the soaking was 0.5. The resulting steel sheets were then each subjected to coating with MgO and then final annealing, whereby steel sheet samples of Experiment 3 were obtained.

FIG. 4 shows relationship between the upper limit temperature in heating at 300° C./second vs. magnitude of warpage of a steel sheet (i.e. tension imparted by forsterite film), observed in the steel sheet samples. It is understood from FIG. 4 that higher tension is imparted by forsterite film by setting the upper limit temperature to be 750° C. or lower. Tension imparted by forsterite film decreases when the upper limit temperature exceeds 750° C. presumably because too high temperature of atmosphere in decarburization annealing facilitates oxidization of a surface of a steel sheet to allow scales to be formed on the surface due to a small amount of oxidation source remaining in the steel sheet, thereby disturbing formation of intended subscale morphology, in spite of a non-oxidizing atmosphere controllably set during annealing.

Experiment 4

Cold rolled steel sheets, prepared according to the same protocol as Experiment 1, were subjected to decarburization annealing. In this connection, the cold rolled steel sheets were subjected to: heating from the room temperature to 700° C. at heating rate of 300° C./second in an atmosphere having oxidation potential $P(H_2O)/P(H_2)$ of 0.01; cooling to 650° C.; reheating to 830° C.; and soaking at 830° C. for 200 seconds. Oxidation potential $P(H_2O)/P(H_2)$ of the atmosphere during the reheating (precisely, the reheating and the soaking) was changed in the range of 0.1 to 0.6. The resulting steel sheets were then each subjected to coating with MgO and then final annealing, whereby steel sheet samples of Experiment 4 were obtained.

FIG. 5 shows relationship between oxidation potential of an atmosphere during reheating vs. magnitude of warpage of a steel sheet (i.e. tension imparted by forsterite film), observed in the steel sheet samples. It is understood from FIG. 5 that satisfactory tension is imparted by forsterite film by setting oxidation potential $P(H_2O)/P(H_2)$ of an atmosphere during reheating to be 0.3 or higher. Tension imparted by forsterite film decreased when the oxidation potential $P(H_2O)/P(H_2)$ is less than 0.3 presumably because subscales formed on the steel sheets were too thin.

Next, a synergetic effect caused by combination of grain-size refinement of secondary grain and higher tension imparted by forsterite film was evaluated.

Experiment 5

Cold rolled steel sheets, prepared according to the same protocol as Experiment 1, were subjected to decarburization annealing. In this connection, the decarburization annealing was carried out according to following four patterns.

Pattern I: Decarburization annealing was carried out under the conditions where neither grain-size refinement of secondary grain nor enhancement of forsterite film tension could be attained. Specifically, the cold rolled steel sheets of Pattern I were subjected to: heating to 820° C. at heating rate of 30° C./second in an atmosphere having oxidation potential $P(H_2O)/P(H_2)$ of 0.5; and soaking at 820° C. for 120 seconds in an atmosphere having oxidation potential $P(H_2O)/P(H_2)$ of 0.5.

Pattern II: Decarburization annealing was carried out under the conditions where only grain-size refinement of secondary grain could be attained. Specifically, the cold rolled steel sheets of Pattern II were subjected to: heating from the room temperature to 820° C. at heating rate of 300° C./second in an atmosphere having oxidation potential $P(H_2O)/P(H_2)$ of 0.5; and soaking at 820° C. for 120 seconds in an atmosphere having oxidation potential $P(H_2O)/P(H_2)$ of 0.5.

Pattern III: Decarburization annealing was carried out under the conditions where only enhancement of forsterite film tension could be attained. Specifically, the cold rolled steel sheets of Pattern III were subjected to: heating from the room temperature to 720° C. at heating rate of 30° C./second and subsequent cooling to 650° C. in an atmosphere having oxidation potential $P(H_2O)/P(H_2)$ of 0.01; and reheating to 820° C. and subsequent soaking at 820° C. for 120 seconds in an atmosphere having oxidation potential $P(H_2O)/P(H_2)$ of 0.4.

Pattern IV: Decarburization annealing was carried out under the conditions where both grain-size refinement of secondary grain and enhancement of forsterite film tension could be attained. Specifically, the cold rolled steel sheets of Pattern IV were subjected to: heating from the room temperature to 720° C. at heating rate of 300° C./second and subsequent cooling to 650° C. in an atmosphere having oxidation potential $P(H_2O)/P(H_2)$ of 0.01; and reheating to 820° C. and subsequent soaking at 820° C. for 120 seconds in an atmosphere having oxidation potential $P(H_2O)/P(H_2)$ of 0.4.

FIG. 6 shows iron loss values under Patterns I to IV, respectively. Pattern II where only grain-size refinement of secondary grain was achieved and Pattern III where only enhancement of forsterite film tension was achieved exhibited as iron loss properties-improving effects (expressed as $\Delta W_{17/50}$) only slight decreases in iron loss around 0.02 W/kg to 0.03 W/kg, respectively, as compared with Pattern I. On the other hand, Pattern IV, where grain-size refinement of secondary grain and enhancement of forsterite film tension were combined, exhibited as an iron loss properties-improving effect (expressed as $\Delta W_{17/50}$) significantly large decrease in iron loss of 0.07 W/kg, as compared with Pattern I. Accordingly, it is understood from these results that an iron loss properties-improving effect of a steel sheet, caused under the conditions where both grain-size refinement of secondary grain and enhancement of forsterite film tension can be achieved, is not a simple sum of the iron loss properties-improving effect solely caused by grain-size refinement of secondary grain and the iron loss properties improving-effect solely caused by enhancement of forsterite film tension but much better or higher than the simple sum due to synergy between these two effects.

There has been revealed as described above that a very good iron loss reducing effect can be obtained by controllably setting oxidation potential of an atmosphere and heating rate and carrying out reheating process under predetermined conditions in decarburization annealing.

The present invention is based on the aforementioned discoveries.

Specifically, primary features of the present invention are as follows.

1. A method for manufacturing a grain oriented electrical steel sheet, comprising a series of steps of: preparing a steel slab having a composition including by mass %, C: 0.08% or less, Si: 2.0% to 8.0%, Mn: 0.005% to 1.0%, at least one type of inhibitor selected from AlN (the composition further includes Al: 0.01% to 0.065% and N: 0.005% to 0.012% in this case), MnS (the composition further includes S: 0.005% to 0.03% in this case) and MnSe (the composition further includes Se: 0.005% to 0.03% in this case), and balance as Fe and incidental impurities; rolling the steel slab to obtain a steel sheet having a final sheet thickness; and subjecting the steel sheet to decarburization annealing, coating with annealing separator mainly composed of MgO, and final annealing in this order, characterized in that the method further comprising carrying out the decarburization annealing as continuous annealing including: (1) heating the steel sheet to a temperature in the range of 700° C. to 750° C. at heating rate of 50° C./second or higher at least in a temperature range of 500° C. to 700° C. in an atmosphere having oxidation potential $P(H_2O)/P(H_2)$ equal to or lower than 0.05; (2) then cooling the steel sheet to a temperature range below 700° C. in an atmosphere having oxidation potential $P(H_2O)/P(H_2)$ equal to or lower than 0.05; and (3) reheating the steel sheet to a temperature in the range of 800° C. to 900° C. and retaining the steel sheet at the temperature for soaking in an atmosphere having oxidation potential $P(H_2O)/P(H_2)$ equal to or higher than 0.3.

2. A method for manufacturing a grain oriented electrical steel sheet, comprising a series of steps of: preparing a steel slab having a composition including C: 0.08 mass % or less, Si: 2.0 mass % to 8.0 mass %, Mn: 0.005 mass % to 1.0 mass %, Al: 100 mass ppm or less, S: 50 mass ppm or less, N: 50 mass ppm or less, Se: 50 mass ppm or less, and balance as Fe and incidental impurities; rolling the steel slab to obtain a steel sheet having a final sheet thickness; and subjecting the steel sheet to decarburization annealing, coating with annealing separator mainly composed of MgO, and final annealing in this order, characterized in that the method further comprising carrying out the decarburization annealing as continuous annealing including: (1) heating the steel sheet to a temperature in the range of 700° C. to 750° C. at heating rate of 50° C./second or higher at least in a temperature range of 500° C. to 700° C. in an atmosphere having oxidation potential $P(H_2O)/P(H_2)$ equal to or lower than 0.05; (2) then cooling the steel sheet to a temperature range below 700° C. in an atmosphere having oxidation potential $P(H_2O)/P(H_2)$ equal to or lower than 0.05; and (3) reheating the steel sheet to a temperature in the range of 800° C. to 900° C. and retaining the steel sheet at the temperature for soaking in an atmosphere having oxidation potential $P(H_2O)/P(H_2)$ equal to or higher than 0.3.

3. The method for manufacturing a grain oriented electrical steel sheet of item 1 or 2 above, wherein the composition of the steel slab further includes by mass %, at least one element selected from Ni: 0.03% to 1.50%, Sn: 0.01% to 1.50%, Sb: 0.005% to 1.50%, Cu: 0.03% to 3.0%, P: 0.03% to 0.50%, Mo: 0.005% to 0.1%, and Cr: 0.03% to 1.50%.

4. The method for manufacturing a grain oriented electrical steel sheet of any of items 1 to 3 above, wherein the process steps comprise subjecting the steel slab to hot rolling and subjecting a hot rolled steel sheet thus obtained to optional hot band annealing and either a single cold rolling process or two or more cold rolling processes interposing intermediate annealing(s) therebetween to obtain a steel sheet having the final sheet thickness.

Advantageous Effect of the Invention

According to the present invention it is possible to obtain a grain oriented electrical steel sheet exhibiting a much remarkable iron loss reducing effect than the conventional grain oriented electrical steel sheet.

DESCRIPTION OF THE EMBODIMENTS

Figure 1:
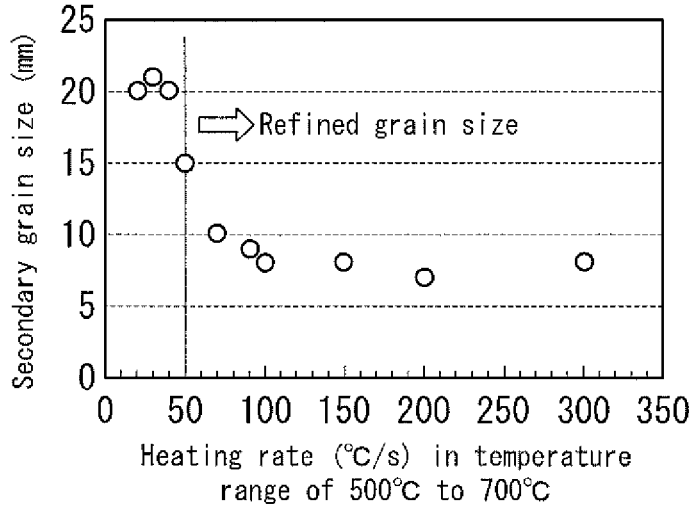
FIG. 1 is a graph showing relationship between heating rate during decarburization annealing vs. resulting secondary grain size of a steel sheet, observed in steel sheet samples.

The present invention will be described in detail hereinafter.

First, reasons for why components of molten steel for manufacturing an electrical steel sheet of the present invention are to be restricted as described above will be explained. Symbols "%" and "ppm" regarding the components of molten steel and a steel sheet represent mass % and mass ppm, respectively, in the present invention unless specified otherwise.

C: 0.08% or less

Carbon content in steel is to be restricted to 0.08% or less because carbon content in steel exceeding 0.08% makes it difficult to reduce carbon in a production process to a level of 50 ppm or below at which magnetic aging can be safely avoided. The lower limit of carbon is not particularly required because secondary recrystallization of steel can occur even in a steel material containing no carbon.

Si: 2.0% to 8.0%

Silicon is an effective element in terms of enhancing electrical resistance of steel and improving iron loss properties thereof. Silicon content in steel lower than 2.0% cannot achieve such good effects of silicon sufficiently. However, Si content in steel exceeding 8.0% significantly deteriorates formability (workability) and also decreases flux density of the steel. Accordingly, Si content in steel is to be in the range of 2.0% to 8.0%.

Mn: 0.005% to 1.0%

Manganese is an element which is necessary in terms of achieving satisfactory hot workability of steel. Manganese content in steel lower than 0.005% cannot cause such a good effect of manganese. However, Mn content in steel exceeding 1.0% deteriorates magnetic flux density of a product steel sheet. Accordingly, Mn content in steel is to be in the range of 0.005% to 1.0%.

At least one of AlN, MnS and MnSe as the conventionally known inhibitors may be added to the composition of the molten steel for the purpose of controlling secondary recrystallization behavior of the steel. The composition of the molten steel, when such an inhibitor as described above is added thereto, may further include at least one group of elements selected from: Al: 0.01% to 0.065% (preferably at least 180 ppm) and N: 0.005% to 0.012% (preferably at least 0.006%) in a case where AlN is used; S: 0.005% to 0.03% (preferably at least 60 ppm) in a case where MnS is used; and Se: 0.005% to 0.03% (preferably at least 180 ppm) in a case where MnSe is used, to ensure that the inhibitor(s) functions satisfactorily. However, contents of the inhibitor components need to be reduced in a case where the steel slab is heated at relatively low temperature (i.e. in a case where an inhibitorless steel material is used). Specifically, the upper limits of contents of the inhibitor components in an inhibitorless steel material are to be Al: 0.01% (100 ppm), preferably 80 ppm, S: 0.005% (50 ppm), preferably 25 ppm, N: 0.005% (50 ppm), preferably 40 ppm, and Se: 0.005% (50 ppm), preferably 10 ppm, respectively. These inhibitor components can remain in the composition of the inhibitorless steel material so as not to exceed the aforementioned upper limits thereof because excessively reducing these contents may incur high cost, although contents of the inhibitor components are preferably reduced as best as possible in terms of ensuring good magnetic properties of the inhibitorless steel material.

The composition of molten steel for manufacturing the electrical steel sheet of the present invention may further contain, in addition to the aforementioned basic components, following elements known as magnetic property improving components. At least one element selected from Ni: 0.03% to 1.50%, Sn: 0.01% to 1.50%, Sb: 0.005% to 1.50%, Cu: 0.03% to 3.0%, P: 0.03% to 0.50%, Mo: 0.005% to 0.1%, and Cr: 0.03% to 1.50%.

Nickel is a useful element in terms of improving microstructure of a hot rolled steel sheet for better magnetic properties thereof. Nickel content in steel lower than 0.03% cannot cause this good effect of improving magnetic properties in a satisfactory manner, while nickel content in steel exceeding 1.50% makes secondary recrystallization of the steel unstable to deteriorate magnetic properties thereof. Accordingly, nickel content in steel is to be in the range of 0.03% to 1.50%.

Sn, Sb, Cu, P, Mo and Cr are each useful elements in terms of improving magnetic properties of steel. Each of these elements, when content thereof in steel is lower than the aforementioned lower limit, cannot sufficiently cause the good effect of improving magnetic properties of the steel, while content thereof in steel exceeding the aforementioned upper limit may deteriorate growth of secondary recrystallized grains of the steel. Accordingly, contents of these elements in the electrical steel sheet of the present invention are to be within the ranges described above, respectively. The balance or remainder of the composition of molten steel for manufacturing the electrical steel sheet of the present invention is incidental impurities and Fe.

A slab may be prepared by the conventional ingot-making or continuous casting method, or a thin cast slab/strip having thickness of 100 mm or less may be prepared by direct continuous casting, from the molten steel having the component composition described above in the present invention. The slab may be either heated by the conventional method to be fed to hot rolling or directly subjected to hot rolling after the casting process without being heated. In a case of a thin cast slab/strip, the slab/strip may be either hot rolled or directly fed to the next process skipping hot rolling.

A hot rolled steel sheet (or the thin cast slab/strip which skipped hot rolling) is then subjected to annealing according to necessity. Subjecting a hot rolled steel sheet or the like to annealing is effective in terms of ensuring highly satisfactory formation of Goss texture in a resulting product steel sheet in a case where band structure derived from hot rolling is retained in the hot rolled steel sheet. The hot rolled steel sheet or the like is preferably annealed in the temperature range of 800° C. to 1100° C. (inclusive of 800° C. and 1100° C.), in this regard. When the hot rolled steel sheet or the like is annealed at temperatures lower than 800° C., band structure derived from hot rolling is retained in the steel sheet after all, thereby making it difficult to realize primary recrystallized microstructure constituted of uniformly-sized grains and thus harming smooth proceeding of secondary recrystallization. When the hot rolled steel sheet or the like is annealed at temperatures exceeding 1100° C., grains of the hot rolled steel sheet after annealing are exceedingly coarsened, which is very disadvantageous in terms of realizing primary recrystallized microstructure constituted by uniformly-sized grains and harms smooth proceeding of secondary recrystallization.

The hot rolled steel sheet thus annealed is subjected to a single cold rolling process or two or more cold rolling processes optionally interposing intermediate annealing therebetween, then recrystallization annealing process, and coating process of providing the steel sheet with annealing separator thereon. It is effective to carry out the cold rolling process(es) after raising the temperature of the steel sheet to 100° C. to 250° C. and also implement a single aging treatment or two or more aging treatments at temperatures in the range of 100° C. to 250° C. during the cold rolling in terms of satisfactory formation of Goss texture of the steel sheet. Formation of an etching groove for magnetic domain refining after cold rolling is fully acceptable in the present invention.

Decarburization annealing is carried out after completion of the cold rolling. Decarburization annealing is implemented as continuous annealing in terms of cost reduction in the present invention. Further, texture of a steel sheet is improved by controlling heating rate during the decarburization annealing in the present invention. Yet further, morphology of subscale is optimized by controlling heating temperature, soaking temperature, and oxidation potential values of atmosphere during heating and soaking in the present invention.

Specifically, the steel sheet needs to be heated at heating rate of 50° C./second or higher, preferably 100° C./second or higher, at least in a temperature range of 500° C. to 700° C. in the continuous annealing in order to obtain texture having sufficiently small secondary grain size of the steel sheet, as shown in FIG. 1. The upper limit of the heating rate, although it is not particularly restricted, is preferably around 400° C./second in terms of curbing production cost because the effect of refining secondary grain size in the steel sheet reaches a plateau when the heating rate exceeds 400° C./second.

Figure 2:
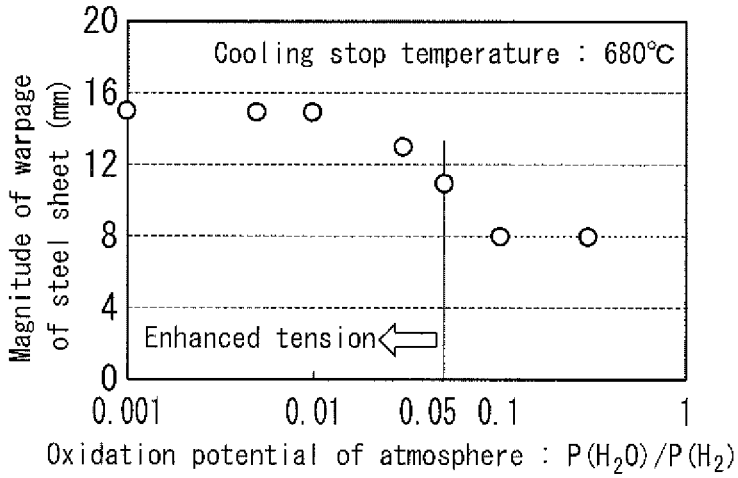
FIG. 2 is a graph showing relationship between oxidation potential of atmosphere during heating in decarburization annealing vs. magnitude of warpage of a steel sheet (which is an index of tension imparted by forsterite film), observed in steel sheet samples.
Figure 4:
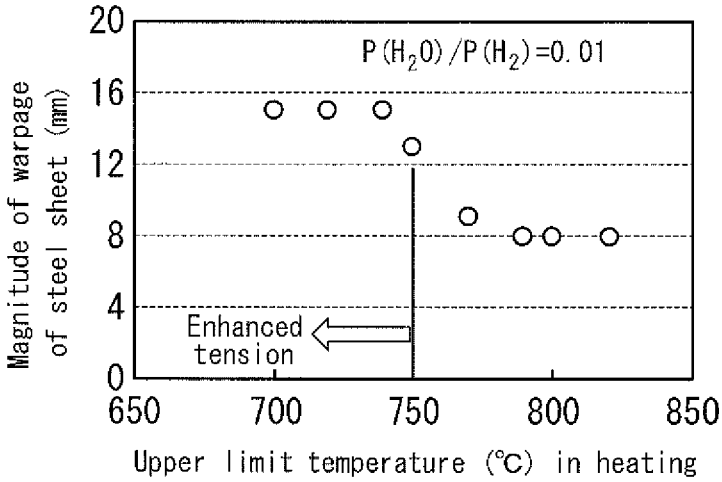
FIG. 4 is a graph showing relationship between the upper limit temperature in heating vs. magnitude of warpage of a steel sheet, observed in steel sheet samples.

Further, the steel sheet is to be heated to a temperature in the range of 700° C. to 750° C. in an atmosphere having oxidation potential $P(H_2O)/P(H_2) \leq 0.05$, preferably 0.01, i.e. a non-oxidizing atmosphere, to release strains having introduced to the steel sheet prior to formation of subscales as shown in FIG. 2 and FIG. 4, in order to optimize morphology of subscale. The lower limit of oxidation potential of the atmosphere may be set to be around 0.001 in terms of the stable operation, although the lower limit is not particularly restricted and may be zero.

Figure 3:
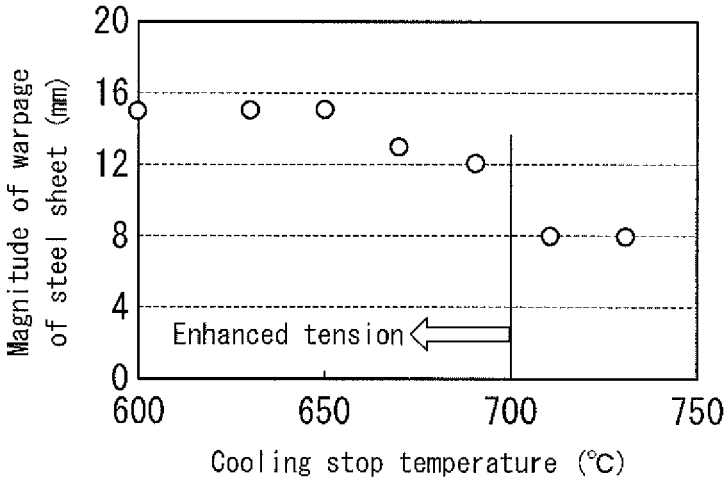
FIG. 3 is a graph showing relationship between cooling stop temperature (i.e. reheating start temperature) vs. magnitude of warpage of a steel sheet (which is an index of tension imparted by forsterite film), observed in steel sheet samples.
Figure 5:
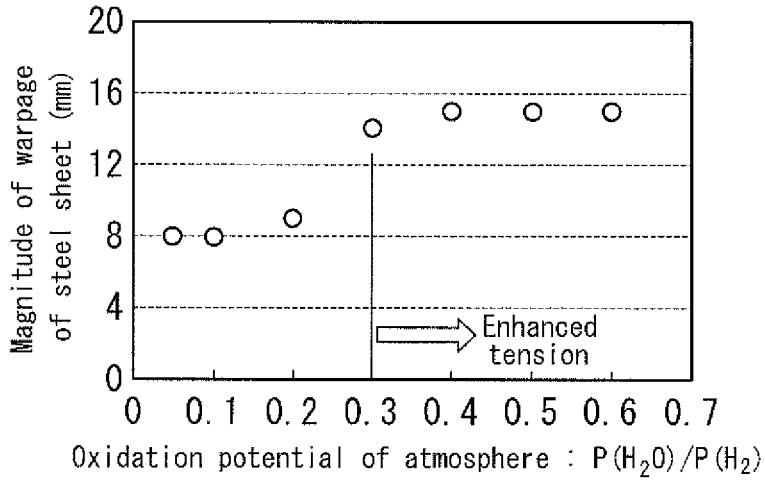
FIG. 5 is a graph showing relationship between oxidation potential of an atmosphere during reheating vs. magnitude of warpage of a steel sheet, observed in steel sheet samples.
Figure 6:
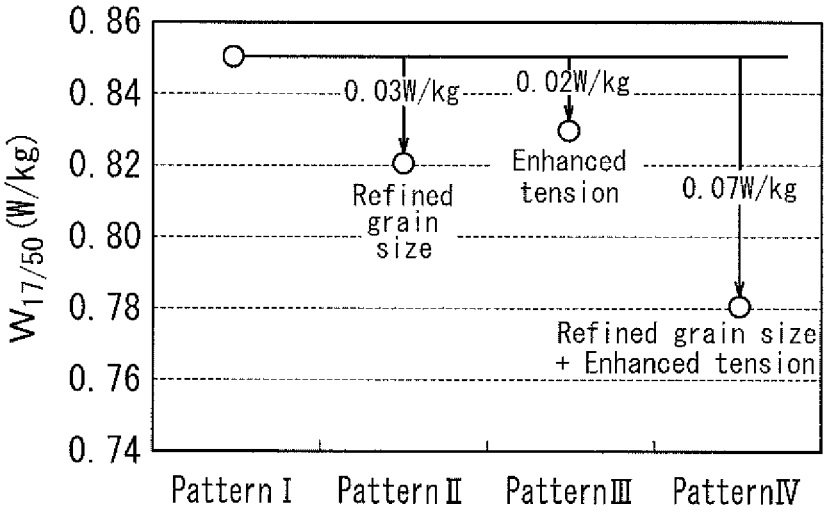
FIG. 6 is a graph showing in a comparative manner iron loss values obtained under respective experiment conditions of decarburization annealing.

The steel sheet thus having strains released therefrom needs to be cooled to a temperature range (cooling stop temperature) below 700° C. in the same atmosphere having oxidation potential $P(H_2O)/P(H_2) \leq 0.05$ and then reheated to a temperature in the range of 800° C. to 900° C. in an atmosphere having oxidation potential $P(H_2O)/P(H_2)$ 0.3, as shown in FIG. 3 and FIG. 5. Here, formation of subscale is not sufficient when the steel sheet fails to be reheated to reach 800° C., while subscales unsuitable for decarburization and tension enhancement will be resulted when the steel sheet is heated above 900° C.

The lower limit of oxidation potential of the atmosphere during the cooling process of the steel sheet may be set to be around 0.001 in terms of the stable operation, although the lower limit is not particularly restricted and may be zero. The lower limit of the cooling stop temperature, although it is not particularly restricted, is preferably around 400° C. in terms of suppressing energy consumption during the reheating process.

The upper limit of oxidation potential of the atmosphere during the reheating process of the steel sheet, although it is not particularly restricted, is preferably around 0.8 in terms of curbing cost because raising oxidation potential of the atmosphere more than necessary results in meaningless increase in cost.

Cooling rate in the cooling process and heating rate in the subsequent reheating process, although they are not particularly restricted, are generally set to be in the range of 8° C./second to 50° C./second and in the range of 5° C./second to 40° C./second, respectively. It is preferable to decrease the temperature of the steel sheet by at least 10° C. in the cooling process.

With regard to soaking after reheating the steel sheet, the soaking needs to be carried out in an atmosphere having oxidation potential $P(H_2O)/P(H_2) \geq 0.3$, wherein the upper limit of the oxidation potential is preferably around 0.8 as in the reheating. The soaking temperature needs to be substantially equal to the reheating completion temperature, i.e. in the range of 800° C. to 900° C. Formation of subscale is not sufficient when the steel sheet fails to be reheated to reach 800° C., while subscales unsuitable for decarburization and tension enhancement will be resulted when the steel sheet is heated above 900° C. Soaking time is preferably in the range of 10 seconds to 300 seconds. Soaking time ≥10 seconds ensures stable formation of subscales. Soaking time, however, is preferably ≤300 seconds in terms of cost reduction because the effect of both stable subscale formation and decarburization reach plateaus, when the soaking time exceeds 300 seconds.

Thereafter, the steel sheet is coated with annealing separator mainly composed of MgO and subjected to final annealing for secondary recrystallization and purification. The expression that "the annealing separator is mainly composed of MgO" means that the annealing separator may contain the conventionally known annealing separator components and physical and/or chemical property-improving components other than MgO unless presence thereof disturbs satisfactory formation of forsterite film targeted by the present invention. Content of MgO in the annealing separator generally corresponds to at least 50 mass % of solid content of the annealing separator. The steel sheet subjected to the final annealing is coated with insulation coating and dried, so that insulation coating is formed thereon. The use of coating agent mainly composed of phosphate salt and colloidal silica is advantageous because coating applied onto the steel sheet by baking the coating agent imparts sufficiently high tension to the steel sheet for further reduction of iron loss therein.

EXAMPLES

Example 1

Slab samples having chemical compositions as shown in Table 1 (the balance was Fe and incidental impurities in each chemical composition) were manufactured by continuous casting. The slab samples A, C, E, F, H, I, J, K and L each containing inhibitor components were heated to 1410° C. and the slab samples B, D and G not containing inhibitor components were heated to 1200° C. Each of these slab samples was then hot rolled to a sheet having thickness: 2.0 mm. The hot rolled steel sheet thus obtained was annealed at 1000° C. for 180 seconds. The steel sheet thus annealed was subjected to cold rolling so as to have sheet thickness: 0.75 mm and then intermediate annealing at 830° C. for 300 seconds at oxidation potential of atmosphere $P(H_2O)/P(H_2)$ of 0.30. Thereafter, subscales at surfaces of the steel sheet were removed by pickling with hydrochloric acid and then the steel sheet was subjected to cold rolling again to obtain a cold rolled steel sheet having thickness: 0.23 mm.

TABLE 1

| Steel sample ID | Chemical composition | | | | | | | | | | | | | |
|---|---|---|---|---|---|---|---|---|---|---|---|---|---|---|
| | C (%) | Si (%) | Mn (%) | Al (ppm) | N (ppm) | S (ppm) | Se (ppm) | Ni (%) | Cu (%) | P (%) | Mo (%) | Cr (%) | Sb (ppm) | Sn (ppm) |
| A | 0.07 | 3.05 | 0.05 | 250 | 100 | 15 | 5 | 0.01 | 0.01 | 0.01 | 0.002 | 0.01 | 10 | 10 |
| B | 0.05 | 3.25 | 0.05 | 70 | 40 | 20 | 5 | 0.01 | 0.01 | 0.01 | 0.002 | 0.01 | 10 | 10 |
| C | 0.07 | 3.15 | 0.04 | 230 | 110 | 20 | 5 | 0.10 | 0.01 | 0.01 | 0.002 | 0.01 | 10 | 10 |
| D | 0.06 | 3.05 | 0.01 | 80 | 30 | 5 | 5 | 0.01 | 0.08 | 0.01 | 0.002 | 0.01 | 10 | 10 |
| E | 0.05 | 3.04 | 0.01 | 300 | 80 | 60 | 10 | 0.01 | 0.01 | 0.09 | 0.002 | 0.01 | 10 | 10 |
| F | 0.05 | 3.30 | 0.08 | 300 | 70 | 5 | 70 | 0.01 | 0.01 | 0.01 | 0.030 | 0.01 | 10 | 10 |
| G | 0.04 | 3.04 | 0.01 | 50 | 30 | 20 | 10 | 0.01 | 0.01 | 0.01 | 0.030 | 0.05 | 10 | 10 |
| H | 0.05 | 2.85 | 0.05 | 250 | 100 | 20 | 5 | 0.01 | 0.01 | 0.01 | 0.002 | 0.01 | 10 | 300 |
| I | 0.07 | 3.35 | 0.06 | 210 | 80 | 10 | 180 | 0.10 | 0.01 | 0.01 | 0.01 | 0.01 | 300 | 10 |
| J | 0.07 | 3.33 | 0.06 | 180 | 100 | 25 | 7 | 0.01 | 0.01 | 0.01 | 0.002 | 0.01 | 250 | 300 |
| K | 0.05 | 3.04 | 0.02 | 230 | 88 | 10 | 5 | 0.01 | 0.01 | 0.01 | 0.002 | 0.05 | 250 | 300 |
| L | 0.07 | 3.25 | 0.07 | 240 | 85 | 5 | 180 | 0.01 | 0.01 | 0.01 | 0.012 | 0.01 | 400 | 10 |

Note:
"%" represents "mass %" and "ppm" represents "mass ppm" in Table 1.

The cold rolled steel sheet thus obtained was subjected to decarburization annealing including soaking at temperature of 840° C. for 200 seconds by using continuous annealing facilities. Other conditions of the decarburization annealing are shown in Table 2. The steel sheet thus decarburization-annealed was then subjected to coating with annealing separator mainly composed of MgO and final annealing for secondary recrystallization and purification in $H_2$ atmosphere at 1250° C. for 30 hours. To the resulting steel sheet, insulation coating agent constituted by 50% colloidal silica and 50% magnesium phosphate was applied and dried, whereby a final product sample was obtained.

Iron loss properties of the final product sample thus obtained were measured according to the method described in JIS C 2550.

The results of iron loss properties of the respective final product samples thus measured are also shown in Table 2.

TABLE 2

| Example No. | Steel sample ID | Conditions of decarburization annealing | | | | | | Iron loss: $W_{17/50}$ (W/kg) | Note |
|---|---|---|---|---|---|---|---|---|---|
| | | Initial heating | | | Cooling | | Reheating | | |
| | | Heatng rate (° C./s) in temeperature range of 500° C. to 700° C. | End-point temperature (° C.) | Oxidation potential of atmosphere: $P(H_2O)/P(H_2)$ | Cooling stop temperature (° C.) | Oxidation potential of atmosphere: $P(H_2O)/P(H_2)$ | Oxidation potential of atmosphere: $P(H_2O)/P(H_2)$ | | |
| 1 | A | 30 | 720 | 0.005 | 705 | 0.001 | 0.45 | 0.82 | Comp. Example |
| 2 | | 30 | 720 | 0.005 | 680 | 0.001 | 0.45 | 0.80 | Comp. Example |
| 3 | | 120 | 720 | 0.250 | 680 | 0.001 | 0.45 | 0.79 | Comp. Example |
| 4 | | 150 | 720 | 0.005 | 680 | 0.001 | 0.45 | 0.75 | Example |
| 5 | B | 120 | 680 | 0.005 | 650 | 0.150 | 0.45 | 0.81 | Comp. Example |
| 6 | | 120 | 680 | 0.010 | 650 | 0.010 | 0.45 | 0.80 | Comp. Example |
| 7 | | 120 | 730 | 0.005 | 650 | 0.010 | 0.25 | 0.79 | Comp. Example |
| 8 | | 150 | 730 | 0.010 | 650 | 0.010 | 0.45 | 0.73 | Example |
| 9 | C | 300 | 780 | 0.007 | 690 | 0.005 | 0.40 | 0.80 | Comp. Example |
| 10 | | 300 | 740 | 0.007 | 690 | 0.005 | 0.40 | 0.76 | Example |
| 11 | D | 300 | 740 | 0.080 | 640 | 0.001 | 0.50 | 0.79 | Comp. Example |
| 12 | | 300 | 740 | 0.001 | 640 | 0.001 | 0.50 | 0.74 | Example |
| 13 | E | 70 | 720 | 0.001 | 710 | 0.007 | 0.60 | 0.79 | Comp. Example |
| 14 | | 70 | 720 | 0.001 | 640 | 0.007 | 0.60 | 0.74 | Example |
| 15 | F | 60 | 700 | 0.005 | 690 | 0.150 | 0.55 | 0.82 | Comp. Example |
| 16 | | 60 | 700 | 0.005 | 690 | 0.010 | 0.55 | 0.77 | Example |
| 17 | G | 200 | 720 | 0.010 | 680 | 0.010 | 0.20 | 0.81 | Comp. Example |

TABLE 2-continued

| | | Conditions of decarburization annealing | | | | | | | |
|---|---|---|---|---|---|---|---|---|---|
| | | Initial heating | | | Cooling | | Reheating | | |
| Example No. | Steel sample ID | Heatng rate (° C./s) in temeperature range of 500° C. to 700° C. | End-point temperature (° C.) | Oxidation potential of atmosphere: $P(H_2O)/P(H_2)$ | Cooling stop temperature (° C.) | Oxidation potential of atmosphere: $P(H_2O)/P(H_2)$ | Oxidation potential of atmosphere: $P(H_2O)/P(H_2)$ | Iron loss: $W_{17/50}$ (W/kg) | Note |
| 18 | | 200 | 720 | 0.010 | 680 | 0.010 | 0.40 | 0.77 | Example |
| 19 | H | 40 | 780 | 0.010 | 640 | 0.010 | 0.50 | 0.83 | Comp. Example |
| 20 | | 250 | 730 | 0.010 | 650 | 0.010 | 0.50 | 0.76 | Example |
| 21 | I | 150 | 720 | 0.080 | 650 | 0.080 | 0.20 | 0.79 | Comp. Example |
| 22 | | 150 | 720 | 0.030 | 650 | 0.010 | 0.50 | 0.75 | Example |
| 23 | J | 200 | 680 | 0.150 | 650 | 0.010 | 0.40 | 0.85 | Comp. Example |
| 24 | | 200 | 700 | 0.010 | 650 | 0.010 | 0.40 | 0.77 | Example |
| 25 | K | 200 | 660 | 0.150 | 650 | 0.010 | 0.45 | 0.83 | Comp. Example |
| 26 | | 200 | 720 | 0.030 | 650 | 0.010 | 0.45 | 0.78 | Example |
| 27 | | 200 | 720 | 0.010 | 650 | 0.010 | 0.45 | 0.77 | Example |
| 28 | L | 320 | 600 | 0.200 | 660 | 0.020 | 0.45 | 0.79 | Comp. Example |
| 29 | | 320 | 730 | 0.020 | 660 | 0.020 | 0.45 | 0.75 | Example |
| 30 | | 320 | 730 | 0.005 | 660 | 0.020 | 0.45 | 0.74 | Example |

It is understood from the results shown in Table 2 that very good iron loss properties were obtained in the product samples each satisfying such relevant conditions in decarburization annealing as specified by the present invention. In contrast, desired iron loss properties were not obtained in the product samples each failing to meet at least one of the relevant conditions in the manufacturing conditions (the decarburization annealing conditions) as specified by the present invention.

Example 2

Slab samples having chemical compositions as shown in Table 1 (the balance was Fe and incidental impurities in each chemical composition) were manufactured by continuous casting. The slab samples A, C, E, F, H, I, J, K and L each containing inhibitor components were heated to 1450° C. and the slab samples B, D and G not containing inhibitor components, were heated to 1230° C. Each of these slab samples was then hot rolled to a sheet having thickness: 2.5 mm. The hot rolled steel sheet thus obtained was annealed at 950° C. for 120 seconds.

The steel sheet thus annealed was subjected to cold rolling so as to have a sheet thickness: 0.95 mm and then intermediate annealing at 900° C. for 100 seconds at oxidation potential of atmosphere $P(H_2O)/P(H_2)$ of 0.45. Thereafter, subscales at surfaces of the steel sheet were removed by pickling with hydrochloric acid and then the steels sheet was subjected to cold rolling again to obtain a cold rolled steel sheet having thickness: 0.23 mm. Grooves with 5 mm spaces therebetween were formed by etching for magnetic domain refining treatment at surfaces of the cold rolled steel sheet thus obtained. The cold rolled steel sheet was then subjected to decarburization annealing including soaking at temperature of 840° C. for 200 seconds by using continuous annealing facilities.

Other conditions of the decarburization annealing are shown in Table 3.

The steel sheet thus decarburization-annealed was then subjected to coating with annealing separator mainly composed of MgO and final annealing for secondary recrystallization and purification in $H_2$ atmosphere at 1250° C. for 30 hours. To the resulting steel sheet, insulation coating agent constituted by 50% colloidal silica and 50% magnesium phosphate was applied and dried, whereby a final product sample was obtained. Iron loss properties of the final product sample thus obtained were measured in the same manner as in Example 1.

The results of iron loss properties of the respective final product samples thus measured are also shown in Table 3.

TABLE 3

| | | Conditions of decarburization annealing | | | | | | | |
|---|---|---|---|---|---|---|---|---|---|
| | | Initial heating | | | Cooling | | Reheating | | |
| Example No. | Steel sample ID | Heatng rate (° C./s) in temeperature range of 500° C. to 700° C. | End-point temperature (° C.) | Oxidation potential of atmosphere: $P(H_2O)/P(H_2)$ | Cooling stop temperature (° C.) | Oxidation potential of atmosphere: $P(H_2O)/P(H_2)$ | Oxidation potential of atmosphere: $P(H_2O)/P(H_2)$ | Iron loss: $W_{17/50}$ (W/kg) | Note |
| 31 | A | 25 | 740 | 0.001 | 710 | 0.001 | 0.55 | 0.70 | Comp. Example |
| 32 | | 25 | 740 | 0.001 | 670 | 0.001 | 0.55 | 0.69 | Comp. Example |
| 33 | | 150 | 730 | 0.400 | 650 | 0.001 | 0.35 | 0.69 | Comp. Example |
| 34 | | 200 | 720 | 0.005 | 650 | 0.001 | 0.55 | 0.65 | Example |
| 35 | B | 180 | 670 | 0.010 | 640 | 0.150 | 0.55 | 0.71 | Comp. Example |
| 36 | | 180 | 670 | 0.010 | 640 | 0.005 | 0.55 | 0.71 | Comp. Example |
| 37 | | 160 | 730 | 0.005 | 640 | 0.005 | 0.20 | 0.69 | Comp. Example |
| 38 | | 160 | 730 | 0.005 | 640 | 0.005 | 0.55 | 0.66 | Example |
| 39 | C | 300 | 780 | 0.006 | 690 | 0.005 | 0.40 | 0.69 | Comp. Example |
| 40 | | 300 | 740 | 0.006 | 690 | 0.005 | 0.40 | 0.66 | Example |
| 41 | D | 200 | 740 | 0.070 | 640 | 0.001 | 0.50 | 0.70 | Comp. Example |
| 42 | | 200 | 740 | 0.001 | 640 | 0.001 | 0.50 | 0.67 | Example |

TABLE 3-continued

| | | Conditions of decarburization annealing | | | | | | | |
|---|---|---|---|---|---|---|---|---|---|
| | | Initial heating | | | Cooling | | Reheating | | |
| Example No. | Steel sample ID | Heatng rate (° C./s) in temeperature range of 500° C. to 700° C. | End-point temperature (° C.) | Oxidation potential of atmosphere: $P(H_2O)/P(H_2)$ | Cooling stop temperature (° C.) | Oxidation potential of atmosphere: $P(H_2O)/P(H_2)$ | Oxidation potential of atmosphere: $P(H_2O)/P(H_2)$ | Iron loss: $W_{17/50}$ (W/kg) | Note |
| 43 | E | 80 | 700 | 0.001 | 710 | 0.007 | 0.60 | 0.69 | Comp. Example |
| 44 | | 80 | 700 | 0.001 | 640 | 0.007 | 0.60 | 0.65 | Example |
| 45 | F | 50 | 720 | 0.005 | 690 | 0.150 | 0.55 | 0.70 | Comp. Example |
| 46 | | 50 | 720 | 0.005 | 690 | 0.010 | 0.55 | 0.67 | Example |
| 47 | G | 100 | 720 | 0.010 | 660 | 0.020 | 0.25 | 0.70 | Comp. Example |
| 48 | | 100 | 720 | 0.010 | 660 | 0.020 | 0.30 | 0.67 | Example |
| 49 | H | 30 | 800 | 0.005 | 620 | 0.010 | 0.40 | 0.70 | Comp. Example |
| 50 | | 150 | 740 | 0.005 | 620 | 0.010 | 0.40 | 0.65 | Example |
| 51 | I | 120 | 720 | 0.100 | 650 | 0.100 | 0.20 | 0.69 | Comp. Example |
| 52 | | 120 | 720 | 0.010 | 650 | 0.010 | 0.50 | 0.66 | Example |
| 53 | J | 250 | 670 | 0.200 | 660 | 0.020 | 0.50 | 0.71 | Comp. Example |
| 54 | | 250 | 710 | 0.010 | 660 | 0.020 | 0.50 | 0.67 | Example |
| 55 | K | 250 | 600 | 0.200 | 660 | 0.020 | 0.50 | 0.71 | Comp. Example |
| 56 | | 250 | 730 | 0.030 | 660 | 0.020 | 0.50 | 0.68 | Example |
| 57 | | 250 | 730 | 0.010 | 660 | 0.020 | 0.50 | 0.67 | Example |
| 58 | L | 200 | 650 | 0.200 | 660 | 0.020 | 0.50 | 0.70 | Comp. Example |
| 59 | | 200 | 740 | 0.020 | 660 | 0.020 | 0.50 | 0.66 | Example |
| 60 | | 200 | 740 | 0.005 | 660 | 0.020 | 0.50 | 0.65 | Example |

It is understood from the results shown in Table 3 that very good iron loss properties were obtained in the product samples each satisfying such relevant conditions in decarburization annealing as specified by the present invention. In contrast, desired iron loss properties were not obtained in the product samples failing to meet even one of the relevant conditions in the manufacturing conditions (the decarburization annealing conditions) as specified by the present invention.

The invention claimed is:

1. A method for manufacturing a grain oriented electrical steel sheet, the method comprising:

preparing a steel slab having a composition comprising:

C: 0.08% or less, by mass %;

Si: 2.0% to 8.0%, by mass %;

Mn: 0.005% to 1.0%, by mass %;

at least one type of inhibitor selected from AlN, in which the composition further comprises Al: 0.01% to 0.065%, by mass % and N: 0.005% to 0.012%, by mass %, MnS, in which the composition further comprises S: 0.005% to 0.03%, by mass %, and MnSe, in which the composition further comprises Se: 0.005% to 0.03%, by mass %; and Fe and incidental impurities;

rolling the steel slab to obtain a steel sheet having a final sheet thickness; and subjecting the steel sheet to, in order, decarburization annealing, coating with annealing separator mainly composed of MgO, and final annealing, wherein the decarburization annealing is carried out as continuous annealing, the continuous annealing comprising:

(1) heating the steel sheet to a temperature in the range of 700° C. to 750° C. at a heating rate of 50° C./second or higher at least in a temperature range of 500° C. to 700° C. in an atmosphere having oxidation potential P(H2O)/P(H2) equal to or lower than 0.05;

(2) then cooling the steel sheet to a temperature in the range of 400° C. to below 700° C. in an atmosphere having oxidation potential P(H2O)/P(H2) equal to or lower than 0.05; and (3) reheating the steel sheet to a temperature in the range of 800° C. to 900° C. and retaining the steel sheet at the temperature for soaking in an atmosphere having oxidation potential P(H2O)/P(H2) equal to or higher than 0.3.

2. A method for manufacturing a grain oriented electrical steel sheet, the method comprising:

preparing a steel slab having a composition comprising:

C: 0.08% or less, by mass %;

Si: 2.0% to 8.0%, by mass %;

Mn: 0.005% to 1.0%, by mass %;

Al: 100 ppm or less, by mass ppm;

S: 50 ppm or less, by mass ppm;

N: 50 ppm or less, by mass ppm;

Se: 50 ppm or less, by mass ppm; and

Fe and incidental impurities;

rolling the steel slab to obtain a steel sheet having a final sheet thickness; and subjecting the steel sheet to, in order, decarburization annealing, coating with annealing separator mainly composed of MgO, and final annealing, wherein the decarburization annealing is carried out as continuous annealing, the continuous annealing comprising:

(1) heating the steel sheet to a temperature in the range of 700° C. to 750° C. at a heating rate of 50° C./second or higher at least in a temperature range of 500° C. to 700° C. in an atmosphere having oxidation potential P(H2O)/P(H2) equal to or lower than 0.05;

(2) then cooling the steel sheet to a temperature in the range of 400° C. to below 700° C. in an atmosphere having oxidation potential P(H2O)/P(H2) equal to or lower than 0.05; and (3) reheating the steel sheet to a temperature in the range of 800° C. to 900° C. and retaining the steel sheet at the temperature for soaking in an atmosphere having oxidation potential P(H2O)/P(H2) equal to or higher than 0.3.

3. The method for manufacturing a grain oriented electrical steel sheet of claim 1, wherein the composition of the steel slab further comprises at least one element selected from Ni:

0.03% to 1.50%, by mass %, Sn: 0.01% to 1.50%, by mass %, Sb: 0.005% to 1.50%, by mass %, Cu: 0.03% to 3.0%, by mass %, P: 0.03% to 0.50%, by mass %, Mo: 0.005% to 0.1%, by mass %, and Cr: 0.03% to 1.50%, by mass %.

4. The method for manufacturing a grain oriented electrical steel sheet of claim 1, wherein rolling the steel slab includes subjecting the steel slab to hot rolling and subjecting a hot rolled steel sheet thus obtained to optional hot band annealing and either a single cold rolling process or two or more cold rolling processes interposing intermediate annealing(s) therebetween to obtain a steel sheet having the final sheet thickness.

5. The method for manufacturing a grain oriented electrical steel sheet of claim 2, wherein the composition of the steel slab further comprises at least one element selected from Ni: 0.03% to 1.50%, by mass %, Sn: 0.01% to 1.50%, by mass %, Sb: 0.005% to 1.50%, by mass %, Cu: 0.03% to 3.0%, by mass %, P: 0.03% to 0.50%, by mass %, Mo: 0.005% to 0.1%, by mass %, and Cr: 0.03% to 1.50%, by mass %.

6. The method for manufacturing a grain oriented electrical steel sheet of claim 2, wherein rolling the steel slab includes subjecting the steel slab to hot rolling and subjecting a hot rolled steel sheet thus obtained to optional hot band annealing and either a single cold rolling process or two or more cold rolling processes interposing intermediate annealing(s) therebetween to obtain a steel sheet having the final sheet thickness.

7. The method for manufacturing a grain oriented electrical steel sheet of claim 3, wherein rolling the steel slab includes subjecting the steel slab to hot rolling and subjecting a hot rolled steel sheet thus obtained to optional hot band annealing and either a single cold rolling process or two or more cold rolling processes interposing intermediate annealing(s) therebetween to obtain a steel sheet having the final sheet thickness.

8. The method for manufacturing a grain oriented electrical steel sheet of claim 5, wherein rolling the steel slab includes subjecting the steel slab to hot rolling and subjecting a hot rolled steel sheet thus obtained to optional hot band annealing and either a single cold rolling process or two or more cold rolling processes interposing intermediate annealing(s) therebetween to obtain a steel sheet having the final sheet thickness.

* * * * *